United States Patent [19]

Lee

[11] Patent Number: 4,777,324

[45] Date of Patent: Oct. 11, 1988

[54] SIGNAL CABLE ASSEMBLY WITH FIBROUS INSULATION

[76] Inventor: Noel Lee, 47 W. Park Dr., Daly City, Calif. 94015

[21] Appl. No.: 32,318

[22] Filed: Mar. 30, 1987

[51] Int. Cl.[4] ..... H01B 11/02

[52] U.S. Cl. ..... 174/34; 174/36; 174/113 R; 174/115; 174/128.1; 174/130

[58] Field of Search ..... 174/27, 32, 34, 113 R, 174/113 C, 115, 128 R, 130, 131 A, 36

[56] References Cited

U.S. PATENT DOCUMENTS

| | | | |
|---|---|---|---|
| 343,082 | 6/1886 | Smith et al. | 174/131 A |
| 448,604 | 3/1891 | Conner | 174/27 |
| 452,340 | 5/1891 | Conner | 174/27 |
| 473,351 | 4/1892 | Sawyer | 174/34 |
| 1,211,153 | 1/1917 | Hochstadter | 174/115 |
| 1,727,971 | 9/1929 | Ford | 174/112 |
| 2,043,401 | 6/1936 | Wells | 174/113 C |
| 2,286,827 | 6/1942 | Morrison | 174/115 |
| 2,658,014 | 11/1953 | Morrison | 174/113 R |
| 2,978,530 | 4/1961 | Braeckman | 174/34 |
| 3,261,907 | 7/1966 | Morrison | 174/115 |
| 3,355,544 | 11/1967 | Costley et al. | 174/106 R |
| 3,602,632 | 8/1971 | Ollis | 174/36 |
| 3,815,054 | 6/1974 | McClure et al. | 174/34 X |
| 3,889,049 | 6/1975 | Legg et al. | 174/113 R X |
| 4,012,577 | 3/1977 | Lang et al. | 174/34 X |
| 4,131,757 | 12/1978 | Felkel | 174/107 |
| 4,158,185 | 6/1979 | Dageforde et al. | 174/113 R X |
| 4,250,351 | 2/1981 | Bridges | 174/106 R |
| 4,461,923 | 7/1984 | Bogese, II | 174/115 X |
| 4,538,023 | 8/1985 | Brisson | 174/115 |

FOREIGN PATENT DOCUMENTS

| | | | |
|---|---|---|---|
| 572618 | 11/1923 | France . | |
| 1472221 | 3/1967 | France | 174/115 |
| 5025 | of 1887 | United Kingdom | 174/113 R |
| 798 | of 1892 | United Kingdom | 174/27 |
| 2049262 | 12/1980 | United Kingdom . | |

*Primary Examiner*—Morris H. Nimmo
*Attorney, Agent, or Firm*—Warren B. Kice

[57] ABSTRACT

A cable assembly including a plurality of wire conductors of varying diameters and a strand of fibrous material wrapped around each conductor or bundles of conductors.

10 Claims, 1 Drawing Sheet

FIG. 1
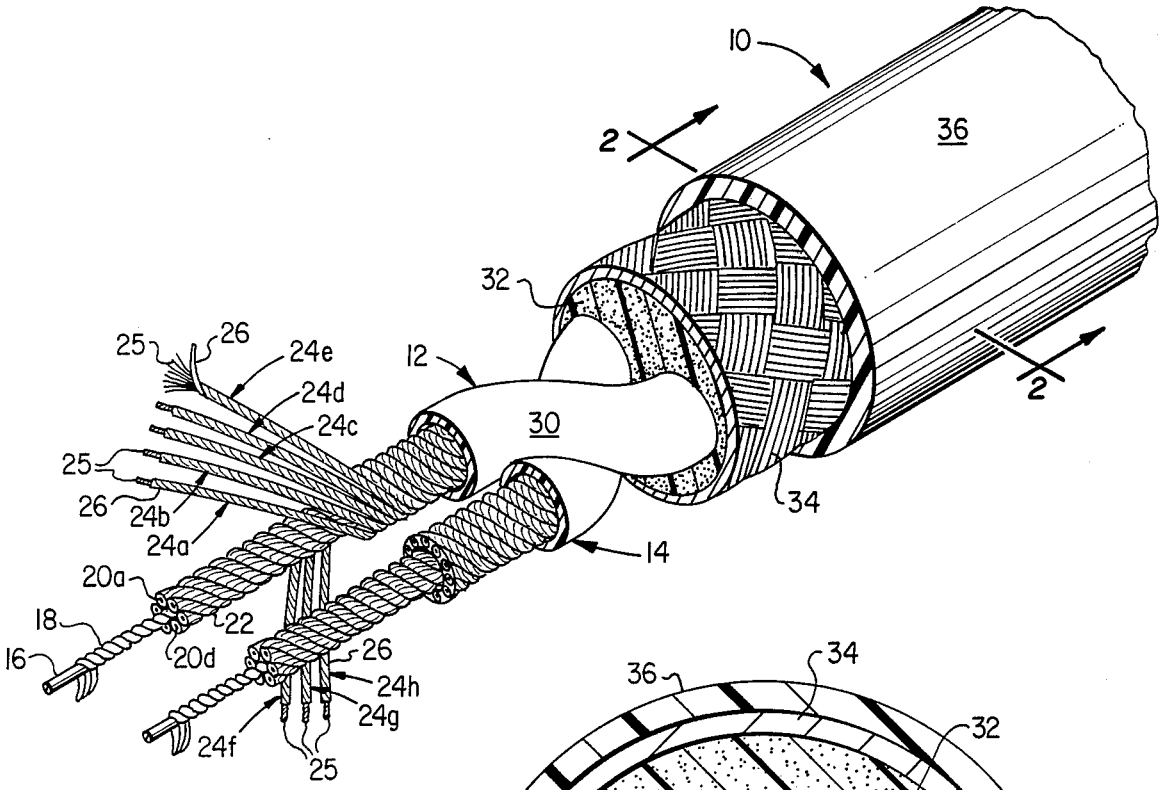
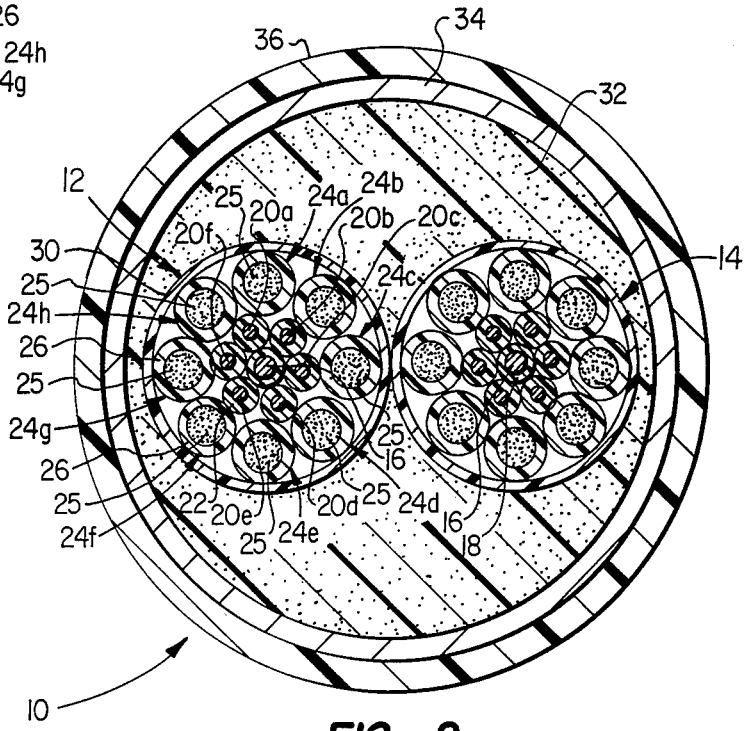
FIG. 2

SIGNAL CABLE ASSEMBLY WITH FIBROUS INSULATION

BACKGROUND OF THE INVENTION

This invention relates to a signal cable assembly and, more particularly, to a cable assembly for transmitting an electrical signal between a power source and a load.

Various types of cables have been used to transfer electrical current between a power source and load. For example, the signal from an audio component such as a tape recorder, compact disc player, phonograph, FM tuner, or the like, is transmitted by a cable to an amplifier for amplifying the signal before it is transferred to a loudspeaker for reproduction. Standard cables of this type are usually formed by a plurality of wire strands surrounded by a sleeve of insulating dielectric material of rubber or plastic. However, this type of insulation causes problems in the reproduced signal for what is believed to be the following reasons.

First of all, the current flowing through a conductor creates a magnetic field extending radially outwardly from the center of the conductor. The magnetic flux within the field is a component of the signal transmitted through the cable, and is momentarily stored by the standard dielectric insulating material and released immediately thereafter. This released energy is, of course, delayed with respect to the main signal passing through the cable which causes aberrations in the signal and a "noise floor".

Secondly, at least a portion of this magnetic flux energy passing through, or briefly stored by, the dielectric is converted to heat and is thus lost which, in the case of an audio cable, caused a reduction in amplitude of the audio signal especially the bass frequencies that are reproduced, and a reduction in the reproduction of the leading edge of the musical transients which also contributes to the loss of clarity in the reproduced audio signal.

SUMMARY OF THE INVENTION

It is therefore an object of the present invention to provide a cable assembly which minimizes distortion caused by changing electromagnetic fields as the audio signal travels through the cable.

It is a further object of the present invention to provide a cable assembly of the above type in which energy losses in the signal as it travels through the cable assembly are minimized.

It is a still further object of the present invention to provide a cable assembly utilizing a plurality of wire conductors of multiple gauges for transmitting various frequency bands of the signal.

It is a still further object of the present invention to provide a cable assembly of the above type in which a strand of insulating material is wrapped around the various conductors to minimize the effect of the electromagnetic fields on the signal.

Toward the fulfillment of these and other objects, the cable assembly of the present invention comprises a plurality of wire conductors, each conductor or bundle of conductors having a fibrous strand of dielectric material wrapped therearound. The conductors can be of different gauges to accomodate different frequency bands of the signal.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings in which:

FIG. 1 is a perspective view of the cable assembly of the present invention with portions thereof being cut away for the convenience of presentation; and FIG. 2 is a large cross-sectional view taken along line 2—2 of FIG. 1.

DESCRIPTION OF THE PREFERRED EMBODIMENTS

Referring specifically to the drawing, the reference numeral 10 refers in general to the cable assembly of the present invention which comprises two cables 12 and 14 which are twisted about each other for substantially the entire length of the assembly. Only the cable 12 will be described in detail since the cable 14 is constructed in an identical manner and with identical components. The cable 12 consists of a central conductor 16 of a conductive material, such as copper, having a string, or strand 18 of a fibrous dielectric material wrapped therearound. Six conductors **20*a*–20*f* are wrapped around the wrapped conductor 16 and a strand 22 of fibrous dielectric material is wrapped around each conductor 20*a*–20*f***.

Eight bundles **24*a*–24*h* of wire strands are wrapped around the conductors 20*a*–20*f*. Each bundle 24*a*–24*h* consists of a plurality of twisted wire strands 25 and a strand of fibrous dielectric material 26** wrapped around the twisted strands.

The strands 18, 22, and 26, the conductors **20*a*–20*f* and the bundles 24*a*–24*e* are all twisted in the same direction, i.e., in a counter-clockwise direction as viewed in FIG. 1**.

The strands 18, 22 and 26 are fabricated from a staple or filament fiber of acetate, aramid, carbon, graphite, cermaic, cotton glass, plastic, silica, quartz or vinyl material and can be spun into spun yarns or filament yarns in accordance with conventional techniques. The strands 18, 22 and 26 are thus relatively low in density and relatively permeable which enables them to capture air in their interstices and thus improve their dielectric properties. As a result, two fairly closely matched insulative materials (fiber and air) operate integrally with minimal insulation characteristic differences and thus provide superior insulative performance.

The diameter of the central conductor 16 is greater than that of each conductor **20*a*–20*f*, which, in turn, is greater than the diameter of each of the wire strands 25 of the bundles 24*a*–24*h*. This use of multiple gauges is due to the fact that the higher frequency components of the signal tend to move towards the outer surface of the cable due to the "skin effect" since the inductance and resistance of the center conductor 16 at high frequencies is greater than that of the bundles 24*a*–24*h*, and due to the fact that the lower frequency components tend to move towards the higher magnetic field in the center of the cable. Thus when an audio signal is applied to the cable assembly 10, the high frequency components from above approximately 700 hertz are concentrated in the outer bundles 24*a*–24*h* of conductors, the low frequency components from approximately 0 to 300 hertz tend to flow through the center conductor 16 and the intermediate frequency components from approximately 300 to 700 hertz tend to flow through the conductors 20a–20f for the reasons described above. Since the higher the frequency of the components of the signal, the faster they ten to travel through the conductors, the lengths of the wire strands 25 of the conductors 24a–24h are greater than those of the conductors 20a–20f which in turn are greater than the lengths of the conductor 16. These lengths are selected so that the various frequency components of the signal arrive at the end of the cable 12** at precisely the same time.

The cable 12 also includes a jacket, or sleeve, 30 of insulating material, such as rubber or plastic, which extends around the assembly formed by the conductor 16, the conductors 20a–20f, the bundles 24a–24h and the strands 18, 22 and 26. Since the cable 14 is identical to the cable 12 it will not be described in any detail.

Both of the cables 12 and 14 are embedded in a twisted relationship in a dielectric material 32 of plastic or rubber which is surrounded by a copper braided shield 34 to provide a shielding function. Finally, an outer insulating sleeve 36, of a dielectric flexible material, such as rubber or plastic, extends around the entire assembly.

With the exception of the conductor 16, all of the components of the cable assembly 10 have been depicted with their lengths cut short for the convenience of presentation, it being understood that in a normal assembly, all of their ends would extend flush with the end of the conductor 16.

One of the cables 12 or 14 can carry the positive signal and the other can carry the negative signal with the respective uninsulated ends of each cable being connected, via conventional connectors, such as spade lugs, banana plugs, or the like, to the positive and negative terminals of two electronic components.

Several advantages result from the foregoing. For example, the high dielectric properties of the fibrous dielectric material extending around the various conductors minimizes the storage and immediate release of the ancillary signal carried by the magnetic flux and thus reduces the introduction of a delayed signal and noise floor as described above. Also when the cable is used to connect audio components, the fibrous dielectric material minimizes the loss of bass energy and reduction in the leading edge of the musical transients.

It is understood that several variations may be made in the foregoing without departing from the scope of the invention. For example, although a dual cable construction is shown which is normally adapted to carry the positive and negative signals, respectively, of an electric signal, it is understood that a single cable is within the scope of the present invention if a proper application exists. Also, one cable assembly can be formed by two sub-assemblies, each consisting of multiple pairs of cables identical to the cables 12 and 14. Further it is understood that the cable is not limited to combinations of three conductors or series of conductors of varying diameters, but can include two conductors or series of conductors of varying diameters in various combinations. Also, the degree of wrapping of the wire strands and conductors can vary within the scope of the invention.

It is also understood that although the cable assembly of the present invention is especially designed for use in audio and video applications, the invention is not so limited but is suited for any type of application in which it is desired to transfer an electrical signal between a source and a load with a minimum of aberrations in the signal.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention therein.

What is claimed is:

1. A cable assembly comprising a first conductor assembly for passing a positive electrical signal, said first conductor assembly comprising:

a central conductor, a strand of fibrous dielectric material wrapped around said central conductor, a plurality of additional conductors formed into a plurality of bundles wrapped around said strand of fibrous dielectric material, and a strand of fibrous dielectric material wrapped around each of said bundles; and a second conductor assembly for passing a negative electric signal, said second conductor assembly comprising:

a central conductor, a strand of fibrous dielectric material wrapped around said central conductor, a plurality of additional conductors formed into a plurality of bundles wrapped around said strand of fibrous dielectric material, and a strand of fibrous dielectric material wrapped around each of said bundles.

2. The cable assembly of claim 1 wherein the strands extending around each of said bundles are wrapped in the same direction as said bundles.

3. The cable assembly of claim 1 wherein each of said conductor assemblies further comprises a plurality of intermediate conductors extending between said central conductor and said bundles.

4. The cable assembly of claim 3 further comprising a fibrous dielectric material extending around each of said intermediate conductors.

5. The cable assembly of claim 4 wherein the fibrous dielectric material extending around said intermediate conductors is in the form of a strand which is wrapped around each of said intermediate conductors.

6. The cable assembly of claim 5 wherein the strands extending around each of said intermediate conductors are wrapped in the same direction as said bundles.

7. The cable assembly of claim 3 wherein the diameter of each central conductor is greater than that of each intermediate conductor and the diameter of each intermediate conductor is greater than that of each conductor in each of said bundles.

8. The cable assembly of claim 3 wherein said intermediate conductors are wrapped around said central conductor and said bundles are wrapped around said intermediate conductors.

9. The cable assembly of claim 1 wherein said first conductor assembly and said second conductor assembly are twisted about each other for substantially the entire length of said cable assembly.

10. The cable assembly of claim 9, further comprising an insulation sleeve extending around both of said twisted conductor assemblies.

* * * * *